US005829539A

United States Patent [19]

Newton et al.

[11] Patent Number: 5,829,539

[45] Date of Patent: Nov. 3, 1998

[54] ROTARY DRILL BIT WITH HARDFACED FLUID PASSAGES AND METHOD OF MANUFACTURING

[75] Inventors: Alex Newton; John Deane, both of Houston; Douglas Caraway, Kingwood, all of Tex.; Andrew Murdock, Bridgend, England; Michael Barnes, Abbeydale, England; Haydn Lamb, Longdon, England

[73] Assignee: Camco Drilling Group Limited, Stonehouse, England

[21] Appl. No.: 800,156

[22] Filed: Feb. 13, 1997

[30] Foreign Application Priority Data

Feb. 17, 1996 [GB] United Kingdom ..... 96034020

[51] Int. Cl.[6] ..... E21B 10/60; B21K 5/02

[52] U.S. Cl. ..... 175/393; 76/108.4

[58] Field of Search ..... 175/339, 340, 175/393; 76/108.2, 108.4

[56] References Cited

U.S. PATENT DOCUMENTS

| | | | |
|---|---|---|---|
| 3,112,803 | 12/1963 | Rowley | 175/393 X |
| 3,180,440 | 4/1965 | Bridwell | 175/393 |
| 3,298,451 | 1/1967 | Eckel et al. | 175/393 |
| 4,083,417 | 4/1978 | Arnold | 175/393 |
| 4,630,692 | 12/1986 | Ecer | 175/405.1 |
| 4,640,711 | 2/1987 | Lichti et al. | 75/248 |
| 4,685,359 | 8/1987 | Worthen et al. | 76/108.4 X |
| 5,072,796 | 12/1991 | Shen et al. | 175/340 |

FOREIGN PATENT DOCUMENTS

| | | |
|---|---|---|
| 0200476 | 11/1986 | European Pat. Off. . |
| 0360111 | 3/1990 | European Pat. Off. . |
| 1046876 | 10/1966 | United Kingdom . |
| 2211874 | 7/1989 | United Kingdom . |

*Primary Examiner*—David J. Bagnell

[57] ABSTRACT

A rotary drill bit, for drilling holes in subsurface formations, comprises a bit body, cutting structures mounted on the bit body, and a fluid supply system for supplying drilling fluid to the surface of the bit body, to cool and clean the cutting structures. The fluid supply system comprises a number of nozzles mounted in the bit body, a main passage in the bit body and a number of auxiliary passages leading from the main passage to the nozzles. Some or all of the passages are at least partly lined with an erosion-resistant lining material. The lining material may comprise a hard facing applied to the internal surface of a preformed passage or a rigid tube which itself defines the internal surface of the passage.

8 Claims, 3 Drawing Sheets

ROTARY DRILL BIT WITH HARDFACED FLUID PASSAGES AND METHOD OF MANUFACTURING

BACKGROUND OF THE INVENTION

The invention relates to rotary drill bits, for drilling holes in subsurface formations, of the kind comprising a bit body, a plurality of cutting structures mounted on the bit body, and a fluid supply system for supplying drilling fluid to the surface of the bit body, to cool and clean the cutting structures, said fluid supply system comprising a number of nozzles mounted in the bit body, a main passage in the bit body and a number of auxiliary passages leading from the main passage to the nozzles respectively.

The invention is particularly, but not exclusively, applicable to drag-type drill bits of the kind where each cutting structure comprises a cutting element mounted on a carrier, such as a stud or post, which is received in a socket in the bit body. One common form of cutting element comprises a circular tablet having a hard facing layer of polycrystalline diamond or other superhard material bonded to a backing layer of less hard material such as cemented tungsten carbide.

Rotary drill bits of this kind are commonly formed by one of two basic methods. In one method, the bit body is machined from a solid blank of machinable metal, usually steel. Alternatively, the bit body may be formed by a powder metallurgy process. In this process a hollow mold is first formed, for example from graphite, in the configuration of the bit body or a part thereof. The mold is packed with a powdered matrix-forming material, such as tungsten carbide, which is then infiltrated with a metal alloy, such as a copper alloy, in a furnace so as to form a hard matrix.

Particularly in cases where the bit body is machined from steel, the surface of such a bit is susceptible to wear and erosion during use, particularly in the vicinity of the nozzles from which abrasive drilling fluid emerges at high velocity and with substantial turbulence. Accordingly, it is fairly common practice to apply a hard facing material to the outer surface of the bit body, at least around the cutting structures. The hard facing material is usually applied by a welding or plasma spraying process.

In addition to the erosion caused by drilling fluid and abrasion on the external surfaces of the bit body, the flow of fluid through the internal fluid supply system of the bit also tends to cause some erosion of the internal surfaces of the fluid flow passages. Hitherto, such erosion has not been considered as particularly significant since normally the drill bit will reach the end of its useful life, as a result of wear, damage and/or external erosion, before the internal erosion has any significant effect on the performance of the drill bit. However, with improvements in the design and construction of drill bits of this type, the life of such bits is being significantly increased, with the result that the problem of internal erosion requires to be addressed. The present invention therefore sets out to provide forms of drill bit construction, and methods of manufacture, where erosion of the internal surfaces of the drill bit is reduced.

SUMMARY OF THE INVENTION

According to the invention there is provided a rotary drill bit, for drilling holes in subsurface formations, comprising a bit body, a plurality of cutting structures mounted on the bit body, and a fluid supply system for supplying drilling fluid to the surface of the bit body, to cool and clean said cutting structures, said fluid supply system comprising a number of nozzles mounted in the bit body, a main passage in the bit body and a number of auxiliary passages leading from the main passage to said nozzles respectively, at least a part of at least one of said passages being lined with a lining material which is more erosion-resistant than the material of the bit body.

The lining material may comprise a layer of hardfacing material applied to the internal surface of part, or all, of a passage preformed in the bit body. The hardfacing material may for example be applied by a spraying, welding, electroplating or powder infiltration process. Alternatively, the hardfacing material may be applied to the surfaces of the passages as a layer of wear-resistant powder and binder, high pressure then being applied to the layer at elevated temperature to consolidate the layer, the pressure being applied via a grain bed of ceramic or refractory particles. Such methods, which are described for example in U.S. Pat. Nos. 4,630,692 and 4,640,711, are well known and will be referred to generally in this specification, for convenience, as grain bed consolidation methods.

Alternatively, the lining material may comprise a preformed rigid tube secured within a passage in the bit body, at least the interior surface of the tube comprising a material which is more erosion-resistant than the material of the bit body. Where at least one of said auxiliary passages is lined with a preformed rigid tube, one end of said tube may project into the interior of said main passage in the bit body.

Each rigid tube may itself be entirely from more erosion-resistant material, or it may comprise a tube of a first material, e.g. steel, to the interior surface of which is applied a hardfacing material. The hardfacing material may be applied to the interior surface of the tube by a method selected from: spraying, welding, electro-plating, a powder infiltration process, or a grain bed consolidation method.

The tube may be secured by mechanically fixing, brazing or shrink-fitting the tube within a correspondingly shaped passage in a preformed bit body, or by molding bit body material around the tube.

Thus, the invention includes within its scope methods of manufacturing a drill bit body of the kind first referred to. A first such method includes the steps of first manufacturing a bit body having an internal main passage and a number of auxiliary passages leading to respective sockets in the bit body to receive nozzles, and then lining at least a part of at least one of said passages with a lining material which is more erosion-resistant than the material of the bit body.

The lining material may be applied to the internal surface of part, or all, of said passage preformed in the bit body by a method selected from: spraying, welding, electro-plating, a powder infiltration process, or a grain bed consolidation method. Alternatively, the lining material may be applied to the bit body by brazing, shrink-fitting or otherwise securing a preformed rigid tube within part or all of a passage in the bit body. The method may comprise the further step of applying a hardfacing material to the internal surface of the tube by a method selected from: spraying, welding, electroplating, a powder infiltration process, or a grain bed consolidation method. Such process may be effected before or after the tube is secured within the bit body.

The invention also provides a method of manufacturing a drill bit body of the kind first referred to comprising forming a hollow mold in the configuration of the bit body or a part thereof, locating within the mold a rigid structure provided said main passage and auxiliary passages, packing the mold around said structure with a powdered matrix-forming material, and then infiltrating said material with a metal alloy in a furnace so as to form a hard matrix, the material of said structure being more erosion-resistant than the solid infiltrated hard matrix, at least on the internal surfaces of said passages.

The structure may comprise a unitary structure or may comprise a plurality of elements secured together or otherwise located in the required position and orientation within the mold.

The invention further provides a modification of this method where the material of the structure itself is not necessarily of greater erosion-resistance than the solid infiltrated matrix material, and wherein the method includes the further step of applying to the internal surfaces of the passages in the said structure a hardfacing material by a spray, welding, electro-plating or powder infiltration process. Said hardfacing material may be applied to the internal surfaces of the structure before the solid matrix material is molded around it, or it may be applied after the bit body has been molded around the structure.

DETAILED DESCRIPTION OF THE PREFERRED EMBODIMENTS

Figure 1:
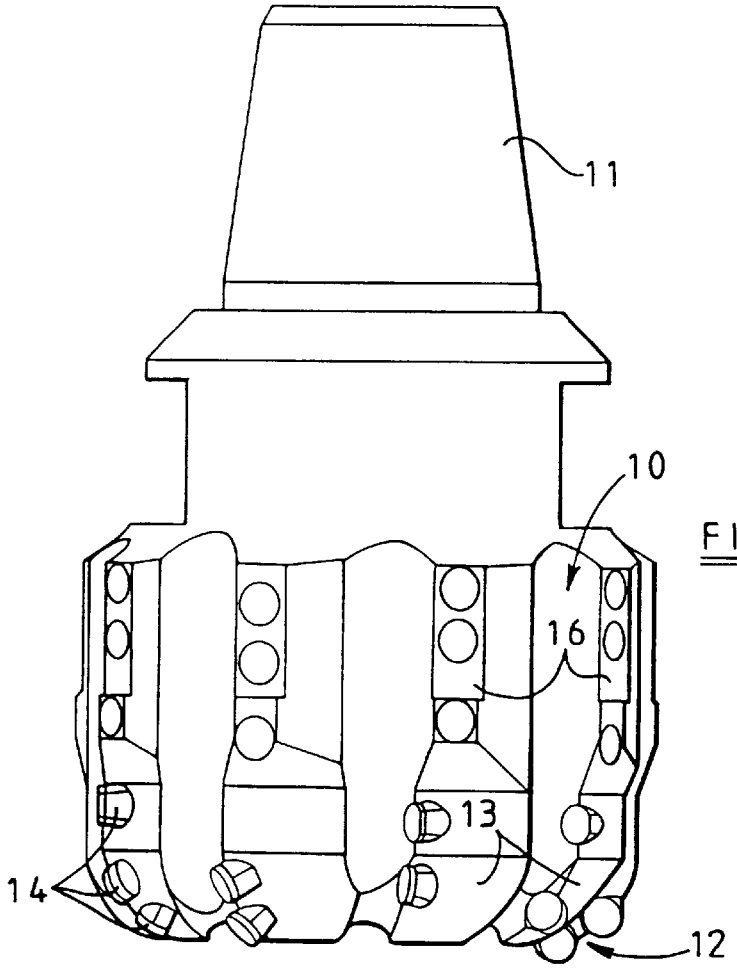
FIG. 1 is a side elevation of a typical drag-type drill bit incorporating the present invention.
Figure 2:
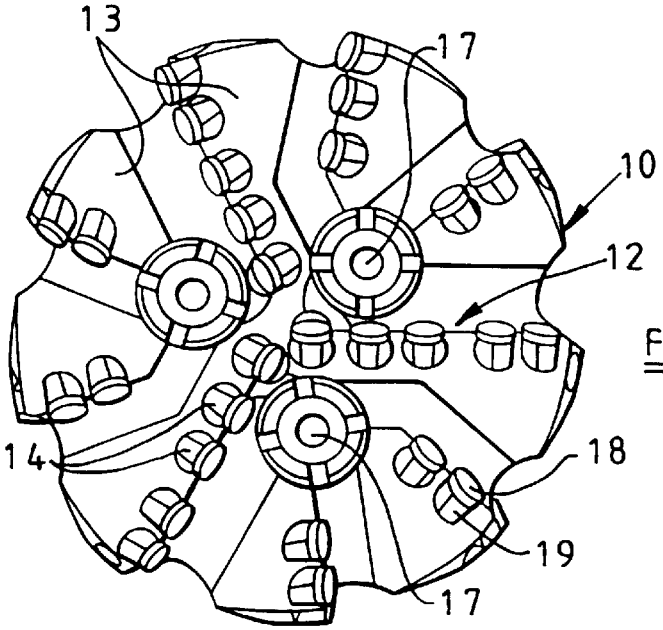
FIG. 2 is an end elevation of the drill bit shown in FIG. 1.

Referring to FIGS. 1 and 2, the bit body 10 is machined from steel, and has at one end a shank including a threaded pin 11 for connection to the drill string. The steel bit body is normally machined by computer-controlled turning and milling operations.

The operative end face 12 of the bit body is formed with a number of blades 13 radiating from the central area of the bit, and the blades each carry cutting structures 14 spaced apart along the length thereof.

The bit has a gauge section including kickers 16 which contact the walls of the borehole to stabilize the bit in the borehole. In known manner abrading elements are mounted in the kickers 16. Internally of the bit there is provided a fluid supply system, which will be described in greater detail in relation to FIG. 3, comprising a central passage in the bit body and shank which communicates through auxiliary passages with nozzles 17 received in the end face 12 of the bit body.

Each cutting structure 14 comprises a preform cutting element 18 mounted on a carrier 19 in the form of a stud which is secured within a socket machined into the bit body. Each preform cutting element 18 is usually in the form of a circular tablet comprising a thin facing table of polycrystalline diamond bonded to a substrate of cemented tungsten carbide, both layers being of uniform thickness. The rear surface of the substrate of each cutting element is brazed to a suitably orientated surface on the stud, which may also be formed from cemented tungsten carbide.

It will be appreciated that this is only one example of the many possible variations of the type of drill bit to which the present invention is applicable.

Figure 3:
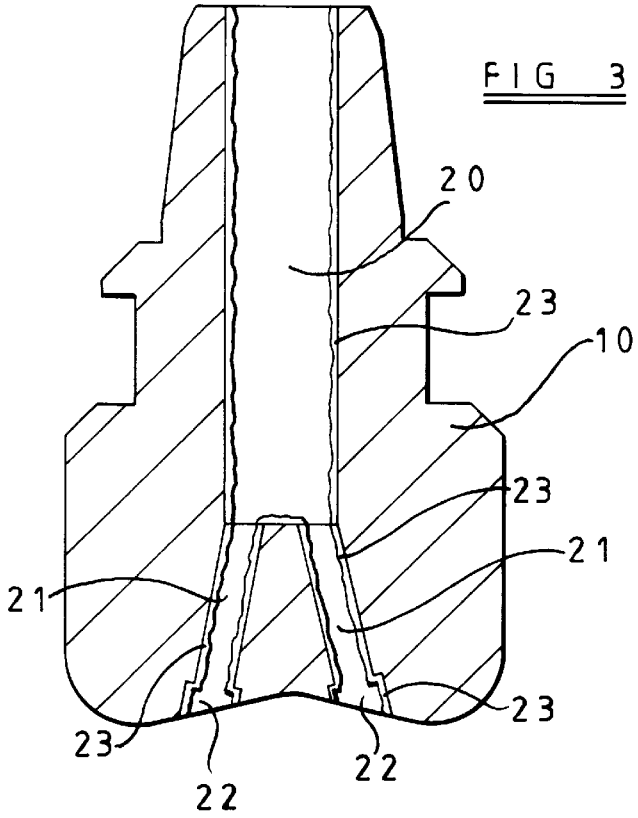
FIG. 3 is a diagrammatic vertical section through the drill bit.

FIG. 3 shows diagrammatically the construction of the fluid supply system within the bit body. The system comprises a central main passage 20 which is cylindrical and of circular cross-section. Auxiliary passages 21, which are also generally cylindrical and of circular cross-section lead from the lower end of the main passage 20 to respective sockets 22 formed in the bit body and into which the nozzles 17 are secured.

In accordance with the present invention, the internal surfaces of the passages 20, 21 are lined with hardfacing material which is more erosion-resistant than the steel of the bit body 10. The sockets 22 may also be lined with hardfacing material, as shown, but this may not be necessary since the nozzle assemblies are usually themselves erosion resistant, in any case. In the embodiment of FIG. 3 the hardfacing material 23 is applied to the internal surfaces of the passages and sockets by any of the well known methods used for applying hardfacing material to the external surfaces of a bit body. For example the material may be applied by spraying on, tig, or stick, by manual metal arc welding, by fusing or brazing processes, by electro-plating or by a powder infiltration process where matrix-forming metal powder, usually tungsten carbide, is infiltrated with a binding alloy, usually copper-based, in a furnace. Alternatively, as previously mentioned, the hardfacing material may be applied to the surfaces of the passages by a grain bed consolidation method whereby a layer of wear-resistant powder and binder is applied to the surface, and a high pressure is then applied to the layer at elevated temperature, via a grain bed of ceramic or refractory particles, to consolidate the layer.

The nature of the hardfacing materials which may be applied by such processes is well known, and typically will contain coarse or fine particles of tungsten carbide, depending on the method of application. However, any other suitable hardfacing material may be employed, such as mixtures of materials selected from silicon carbide, tungsten carbide, diamond, steel, cobalt, and alloys thereof.

After the internal surfaces of the passages and sockets have been hardfaced, machining processes may be required in certain regions, and particularly the internal surfaces of the sockets 22. It may be necessary to machine such sockets, after hardfacing, for example to provide a seat for the nozzle 17 and an O-ring groove. Such machining may be effected by milling, boring or electron discharge machining, depending on the nature of the hardfacing material. Since the material is, of course, very hard, special machining tools will be required, for example tools of diamond or cubic boron nitride tips.

Figure 4:
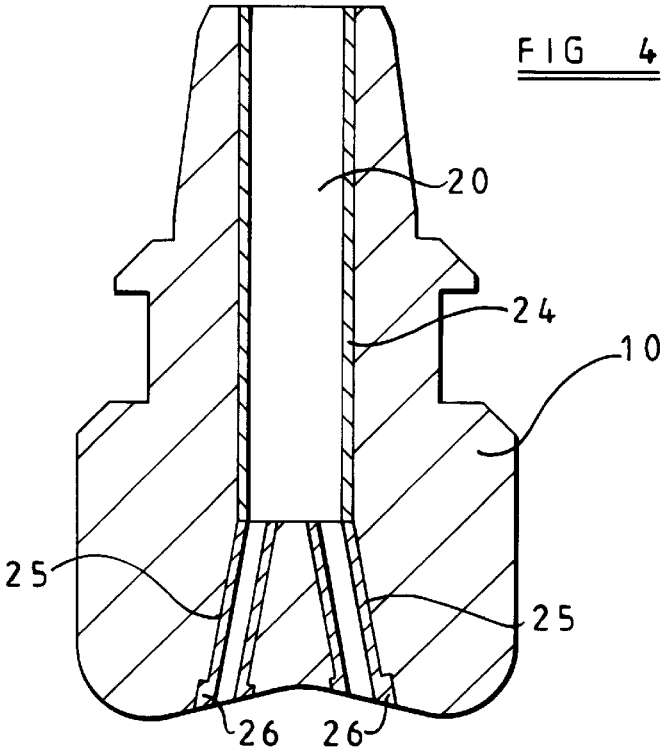
FIG. 4 is a diagrammatic vertical section through an alternative embodiment.

In the alternative arrangement shown in FIG. 4 the main passage 20 is lined with a preformed circular cross-section tube 24, which is fitted after the bit body 10 has been machined. The tube 24 may be fitted within the passage 12 by mechanical fixing, shrink-fitting or brazing, or by any other appropriate means.

Similarly lining tubes 25 are fitted within the auxiliary passages 21 and short tubes, or bushes, 26 within the sockets 22. The bushes 26 may be separately formed from the lining tubes 25 or may comprise enlarged outer diameter sections integrally formed on the ends of the tubes 25.

The tubes 24, 25 and 26 may be entirely formed of a metal which is of greater erosion-resistance than the steel of the bit body. Alternatively, the tubes may be formed of steel, or other metal, to the internal surface of which has been applied a layer of hardfacing material before or after the tubes are fitted within the bit body. The hardfacing material may be applied to the internal surfaces of the tubes by any of the methods described in relation to FIG. 3 and, again, the tubes and/or hardfacing may be subsequently machined as required and as described in relation to FIG. 3.

One suitable material for the tubes 24, 25, 26 may be solid infiltrated matrix material, of the kind from which molded bit bodies are formed, and comprising tungsten carbide particles infiltrated with a copper-based alloy. British Patent No. 2211874 describes a method for applying such infiltrated matrix hardfacing material to the external surfaces of a steel bit body, and methods similar to those described in that specification may be employed in the present invention to apply matrix hardfacing to the internal surfaces of the passages 20, 21 and 22 or to the internal surfaces of tubular linings 24, 25, 26 secured therein.

Although the invention is particularly applicable to steel-bodied bits, which have been described in FIGS. 1–4, the invention may also be applied to molded matrix-bodied bits. In that case, of course, the material of the internal hardfacing or lining requires to be of greater erosion-resistance than the solid infiltrated matrix from which the main part of the bit body itself is formed.

Figure 5:
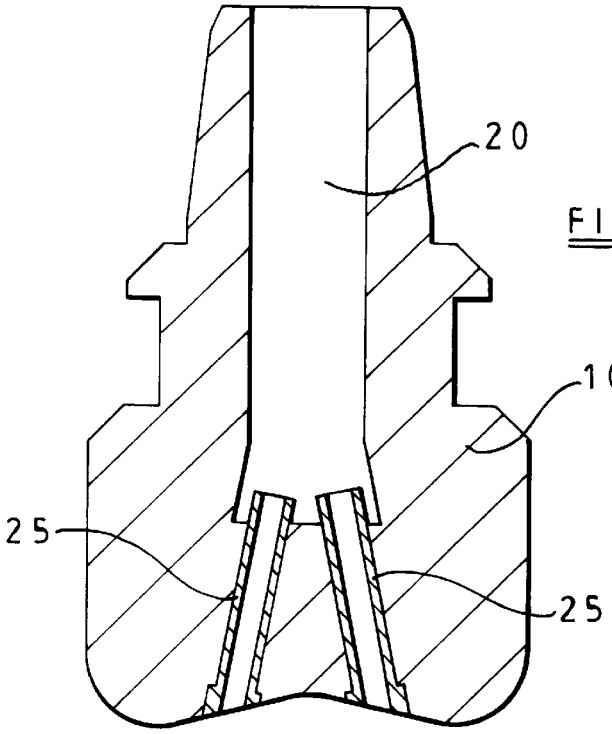
FIG. 5 shows a modified version of the embodiment of FIG. 4.

FIG. 5 shows a modified version of the arrangement of FIG. 4 where the upper ends of the wear-resistant lining tubes 25 project a short distance into the lower end of the main passage 20 in the bit body. Such arrangement may tend to reduce erosion of the bit body around the inlets of the tubes 25, which might otherwise occur due to the flow of abrasive drilling fluid into the tubes. Also, with the arrangement of FIG. 5, any debris entrained in the drilling fluid will tend to be precipitated at the bottom of the passage 20, below the inlets to the tubes 25, thus avoiding such debris passing along the tubes 25 perhaps to block the associated nozzles.

Figure 6:
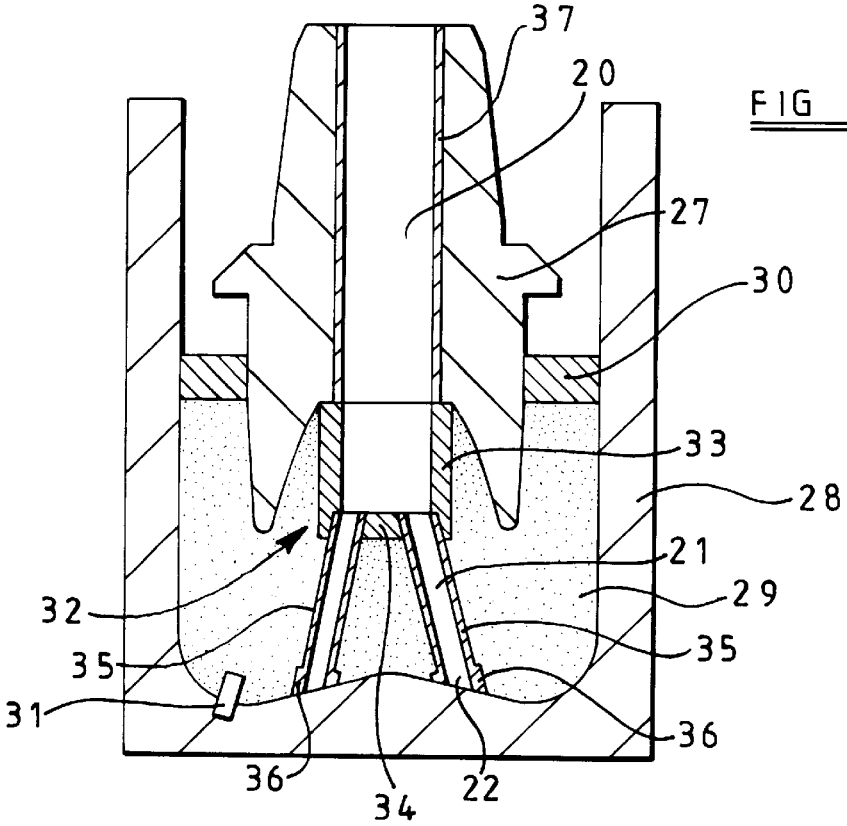
FIG. 6 is a diagrammatic vertical section through a mold showing one method of manufacture of a solid infiltrated matrix-bodied bit, in accordance with the invention.

FIG. 6 shows diagrammatically a method of manufacturing a matrix-bodied bit incorporating the present invention.

Referring to FIG. 6, the basic process for molding a drill bit using a powder metallurgy process is well known. A machined steel former 27, providing the shank and pin of the drill bit, is located in a graphite mold 28 formed in the external configuration of the bit body. The mold is packed, around the lower part of the former 27, with powdered matrix-forming material 29 and a body of fusible alloy, usually a copper-based alloy, 30 is located above the matrix-forming particles.

The mold is then introduced into a furnace so that the alloy 30 fuses and infiltrates downwardly into the material 29 so as, upon subsequent cooling, to form a solid infiltrated matrix which is bonded on to the lower part of the former 27.

In order to provide sockets in the bit body to receive the cutting structures, graphite formers, such as is indicated diagrammatically at 31, are mounted in the walls of the mold so as to project into the matrix-forming material to form the socket.

Similarly, graphite formers are also normally inserted in the mold, before it is packed with matrix-forming material, to define the lower part of the central passage 20, auxiliary passages 21, and sockets 22. After the bit body has been formed the graphite formers are destructively removed to open the passages and nozzle sockets.

In accordance with the invention, however, the passages of the fluid supply system within the bit body are not defined by disposable graphite formers but by a structure 32 formed of material which is of greater erosion-resistance than the solid infiltrated matrix material. In the embodiment shown, the structure 32 comprises a main hollow cylindrical member 33 having an integral bottom closure 34. Auxiliary tubes 35 have their upper ends located within angled sockets within the closure portion 34 and have increased diameter lower portions 36 to define the sockets 22. The upper ends of the tubes 35 may be pre-secured within the angled sockets in the closure portion 34 by shrink-fitting, brazing or other means, although this may not be necessary since they will, in any case, automatically become "brazed" within the sockets by the infiltration alloy, as a result of the infiltration process.

In the course of infiltrating the matrix-forming material, and forming the bit body, the structure 32 becomes permanently embedded within the bit body so as to define fluid flow passages lined with a material which is of greater erosion-resistance than the material of the bit body itself.

As in the arrangement of FIG. 4, the structure 32 may be made entirely of material of greater erosion-resistance, but alternatively it might comprise some other material, only the internal surfaces of the structure being lined with a material of greater erosion-resistance, for example by any of the application methods referred to in relation to FIGS. 3 and 4.

The upper part of the main passage 20 in the steel former 27 is also preferably lined with erosion-resistant material 37, which may be in the form of a preformed inserted tube, or in the form of an applied layer of hardfacing material.

Whereas the present invention has been described in particular relation to the drawings attached hereto, it should be understood that other and further modifications, apart from those shown or suggested herein, may be made within the scope and spirit of the present invention.

What is claimed:

1. A rotary drill bit, for drilling holes in subsurface formations, comprising a bit body, a plurality of cutting structures mounted on the bit body, and a fluid supply system for supplying drilling fluid to the surface of the bit body, to cool and clean said cutting structures, said fluid supply system comprising a number of nozzles mounted in the bit body, a main passage in the bit body and a number of auxiliary passages leading from the main passage to said nozzles respectively, at least a part of at least one of said passages being lined with a lining material comprising a preformed rigid tube of a first material secured within said passage, there being applied to the interior surface of the tube a hardfacing material which is more erosion-resistant than the material of the bit body and which is applied by a method selected from: spraying, welding, electro-plating, a powder infiltration process, or a grain bed consolidation method.

2. A drill bit according to claim 1, wherein at least one of said auxiliary passages is lined with a preformed rigid tube, and wherein one end of said tube projects into the interior of said main passage in the bit body.

3. A drill bit according to claim 1, wherein the tube is secured by a method selected from: mechanically fixing, brazing, shrink-fitting, or molding bit body material around the tube.

4. A method of manufacturing a drill bit body comprising forming a hollow mold in the configuration of at least part of the bit body, locating within the mold a rigid structure providing a main passage and auxiliary passages, packing the mold around said structure with a powdered matrix-forming material, and then infiltrating said material with a metal alloy in a furnace so as to form a hard matrix, the method including the step of applying to the internal surfaces of the passages in the said structure, before the solid matrix material is molded around it, a hardfacing material which is more erosion-resistant than the solid infiltrated hard matrix, the hardfacing material being applied by a method selected from: spraying, welding, electro-plating, a powder infiltration process, or a grain bed consolidation method.

5. A method according to claim 4, wherein the structure comprises a unitary structure located in the required position and orientation within the mold.

6. A method according to claim 4, wherein the structure comprises a plurality of separate elements located in the required position and orientation within the mold.

7. A method of manufacturing a drill bit body including the steps of first manufacturing a bit body having an internal main passage and a number of auxiliary passages leading to respective sockets in the bit body to receive nozzles, securing a preformed rigid tube within at least part of at least one of said passages by a method selected from brazing or shrink fitting, and applying a hardfacing material to the internal surface of the tube, before or after the tube is secured within the bit body, by a method selected from: spraying, welding, electro-plating, a powder infiltration process, or a grain bed consolidation method, the hardfacing material being more erosion-resistant than the material of the bit body.

8. A rotary drill bit, for drilling holes in subsurface formations, comprising a bit body machined from steel, a plurality of cutting structures mounted in sockets formed in the steel bit body, and a fluid supply system for supplying drilling fluid to the surface of the bit body, to cool and clean said cutting structures, said fluid supply system comprising a number of nozzles mounted in the bit body, a main passage in the bit body and a number of auxiliary passages leading from the main passage to said nozzles respectively, at least a part of at least one of said passages being lined with a lining material comprising a layer of hardfacing material applied to the internal surface of said passage, the hardfacing material being more erosion-resistant than the steel from which the bit body is formed, and being applied by a method selected from: spraying, welding, electro-plating, or a grain bed consolidation method.

* * * * *